US006366755B1

(12) United States Patent
Takashima

(10) Patent No.: US 6,366,755 B1
(45) Date of Patent: Apr. 2, 2002

(54) TONER SUPPLYING DEVICE AND DEVELOPER TRANSPORTING DEVICE

(75) Inventor: Yoshiyuki Takashima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/722,036

(22) Filed: Nov. 27, 2000

(30) Foreign Application Priority Data

Apr. 17, 2000 (JP) ..... 2000-114852

(51) Int. Cl.[7] ..... G03G 15/08
(52) U.S. Cl. ..... 399/254; 399/359
(58) Field of Search ..... 399/254, 255, 399/256, 258, 260; 222/DIG. 1; 366/241, 292, 279

(56) References Cited

U.S. PATENT DOCUMENTS 5,130,756 A * 7/1992 Taniyama ..... 399/358
5,335,051 A * 8/1994 Tani ..... 399/253
5,734,957 A * 3/1998 Ogawa et al. ..... 399/359

* cited by examiner

*Primary Examiner*—Sophia S. Chen
(74) *Attorney, Agent, or Firm*—Morgan, Lewis & Bockius LLP

(57) ABSTRACT

A transporting member for transporting toner by its rotation is provided inside a first transporting passage, and that a transporting member provided inside a second transporting passage is moved in a vertical direction through a converter for converting the rotation of the transporting member provided inside the first transporting passage into reciprocation.

6 Claims, 15 Drawing Sheets

TONER SUPPLYING DEVICE AND DEVELOPER TRANSPORTING DEVICE

BACKGROUND OF THE INVENTION

1. Field of the Invention

The present invention relates to a toner supplying device used in an image forming apparatus such as an electrophotographic copying machine, a printer, a facsimile, or the like, and particularly to a toner supplying device applied to an image forming apparatus so constituted that a developing device is positioned on a lower side and a toner supplying device is positioned on an upper side and that the developing device and the toner supplying device are spaced from each other in some degree.

2. Description of the Related Art

In a conventional image forming apparatus such as an electrophotographic copying machine, a printer, a facsimile, or the like, after a surface of a photoconductive drum was uniformly charged with the predetermined electric potential, it is exposed to light and an electrostatic latent image is formed. The electrostatic latent image formed on the surface of the photoconductive drum is made visible by a developing device, that is, it is formed as a toner image. The toner image is transferred/fixed onto a transfer sheet, whereby an image is formed.

In the above image forming apparatus, together with the operation of developing the electrostatic latent image formed on the surface of the photoconductive drum by the developing device, toner within the developing device is consumed. Therefore, a toner supplying device is provided in order to supply the toner to the developing device at the predetermined timing. This toner supplying device is usually constituted so that it is arranged on a side of the developing device, viewed from a front side of an image forming apparatus body and that the toner is supplied to the developing device by transporting the toner from the toner supplying device in the horizontal direction.

However, in the above image forming apparatus, as an image is made into a full color image, the apparatus is miniaturized, or the apparatus runs at a higher speed, recently, new apparatuses having various apparatus designs and layouts are being proposed and being produced.

In an image forming apparatus according to this new proposal, there is an image forming apparatus so constituted that a toner supplying device is spaced from a developing device in some degree and arranged at an upper portion within the image forming apparatus body, and that the developing device is positioned on the lower side and the toner supplying device is positioned on the upper side.

In case of this image forming apparatus so constituted that the developing device is positioned on the lower side and the toner supplying device is positioned on the upper side, and that the developing device and the toner supplying device are spaced from each other in some degree, a transporting passage A that determines the supplied amount of the toner from the toner supplying device and a transporting passage B for supplying the toner transported along the transporting passage A to the developing device are required. Since the transporting passage A determines the amount of the toner supplied from the toner supplying device, a transporting member such as an auger is disposed inside the transporting passage A, and the above transporting passage A is disposed in a substantially horizontal direction. On the other hand, the transporting passage B is disposed in a substantially vertical direction in order to connect the toner supplying device positioned on the upper side to the developing device positioned on the lower side.

As a means for transporting toner in the substantially vertical direction within the transporting passage B connecting the toner supplying device positioned on the upper side to the developing device position on the lower side as described above, there are the following means.

(1) A means so constituted that, as shown in FIG. 14, toner is supplied from a toner supplying device 100 into a first transporting passage 101 disposed in the substantially horizontal direction, that the toner is transported into the first transporting passage 101 by an auger 102 in the horizontal direction and then transported from the first transporting passage 101 into a second transporting passage 103, and that the toner supplied into this second transporting passage 103 is transported according to its natural dropping thereby to be transported to a developing device 104.

(2) A means so constituted that, as shown in FIG. 15, a spring agitator 106 is disposed inside a second transporting passage 103, that an end portion of this spring agitator 106 is directly connected to an auger 102 disposed inside a first transporting passage 101, that the first transporting passage 101 and the second transporting passage 103 are curved with a predetermined curvature radius to be coupled to each other, and that the toner supplied into the second transporting passage 103 is transported to a developing device 104 by the spring agitator 106.

(3) A means so constituted that, as shown in FIG. 16, transporting members 102 and 107 each of which is composed of an individual auger are disposed inside a first transporting passage 101 and a second transporting passage 103, that power is transmitted form a shaft of the transporting member 102 disposed inside the first transporting passage 101 through gears 108, 109 such as a bevel gear, a helical gear or the like to the transporting member 107 such as the auger disposed inside the second transporting passage 103 composed of the auger, and that the toner supplied into the second transporting passage 103 is transported to a developing device 104 by this transporting member 107.

However, the following problems exist in the above conventional arts.

(1) In case that the toner supplied into the second transporting passage 103 is transported according to its natural dropping as shown in FIG. 14, there is a problem that possibility of clogging of the second transporting passage 103 with the toner is large by some size of a diameter or a length of the second transporting passage 103 and by quality of some toner. In order to solve this problem, there is an apparatus so constituted that vibration is applied to the second transporting passage 103. However, in this case, the number of parts increases, which causes an increase in cost and makes the apparatus larger.

(2) In case that the first transporting passage 101 and the second transporting passage 103 are curved with the predetermined curvature radius to be coupled to each other as shown in FIG. 15 and that the toner supplied into the second transporting passage 103 is transported by the spring agitator 106, a large curvature radius must be set at a portion for coupling the first transporting passage 101 and the second transporting passage 103 to each other, which is unadaptable on layout. Further, since the spring agitator 106 is disposed inside the second transporting passage 103 is curved and rotated, it is strongly pressed against a wall surface of the second transporting passage 103, so that there is fear that stress will be given to the toner that is transported inside the second the transporting passage 103, and that a bad influence will be exerted on the toner.

(3) In case that the transporting members 102 and 107 each of which is composed of the individual auger are disposed inside the first transporting passage 101 and the second transporting passage 103 as shown in FIG. 16, and that the power is transmitted from the transporting member 102 disposed inside the first transporting passage 101 through the gears 108, 109 such as the bevel gear, the helical gear or the like to the transporting member 107 disposed inside the second transporting passage 103, there is no problem on transportability of toner but there is a problem that the number of parts such as the gears 108, 109 increases and the increase in cost is caused.

SUMMARY OF THE INVENTION

Therefore, the invention has been made in order to solve the problems of the above conventional arts. Its object is to provide a toner supplying device, which has such a constitution that a developing device is positioned on a lower side, the toner supplying device is positioned on an upper side, and their devices are spaced from each other in some degree; which makes large the freedom of the layout of a transporting passage along which toner is transported from the toner supplying device to the developing device without causing an increase in cost caused by the increase of the number of parts and making the apparatus larger; and which has no fear that stress will be given to the toner transported along the transporting passage and a bad influence will be exerted on the toner.

In order to solve the above problems, according to a first aspect of the invention, in a toner supplying device in which a developing device to which toner is to be supplied is arranged on a lower side and a toner supplying device is arranged on an upper side, and the toner is supplied through a first transporting passage disposed in a substantially horizontal direction and a second transporting passage disposed in a substantially vertical direction; the toner supplying device is so constituted that a transporting member for transporting the toner by its rotation is provided inside the first transporting passage, and that a transporting member provided inside the second transporting passage is moved in the vertical direction through a converter for converting the rotation of the transporting member provided inside the first transporting passage into reciprocation.

Further, according to a second aspect of the invention, the toner supplying device is, in the first aspect, characterized in that the converter for converting the rotation of the transporting member provided inside the first transporting passage into the reciprocation is composed of a crank-shaped shaft provided for the transporting member disposed inside the first transporting passage.

Further, according to a third aspect of the invention, the toner supplying device is, in the first aspect, characterized in that the converter for converting the rotation of the transporting member provided inside the first transporting passage into the reciprocation is composed of an eccentric cam provided for the transporting member disposed inside the first transporting passage.

DETAILED DESCRIPTION OF THE PRESENT INVENTION

Embodiments for carrying our the invention will be described below with reference to drawings.

First embodiment

Figure 2:
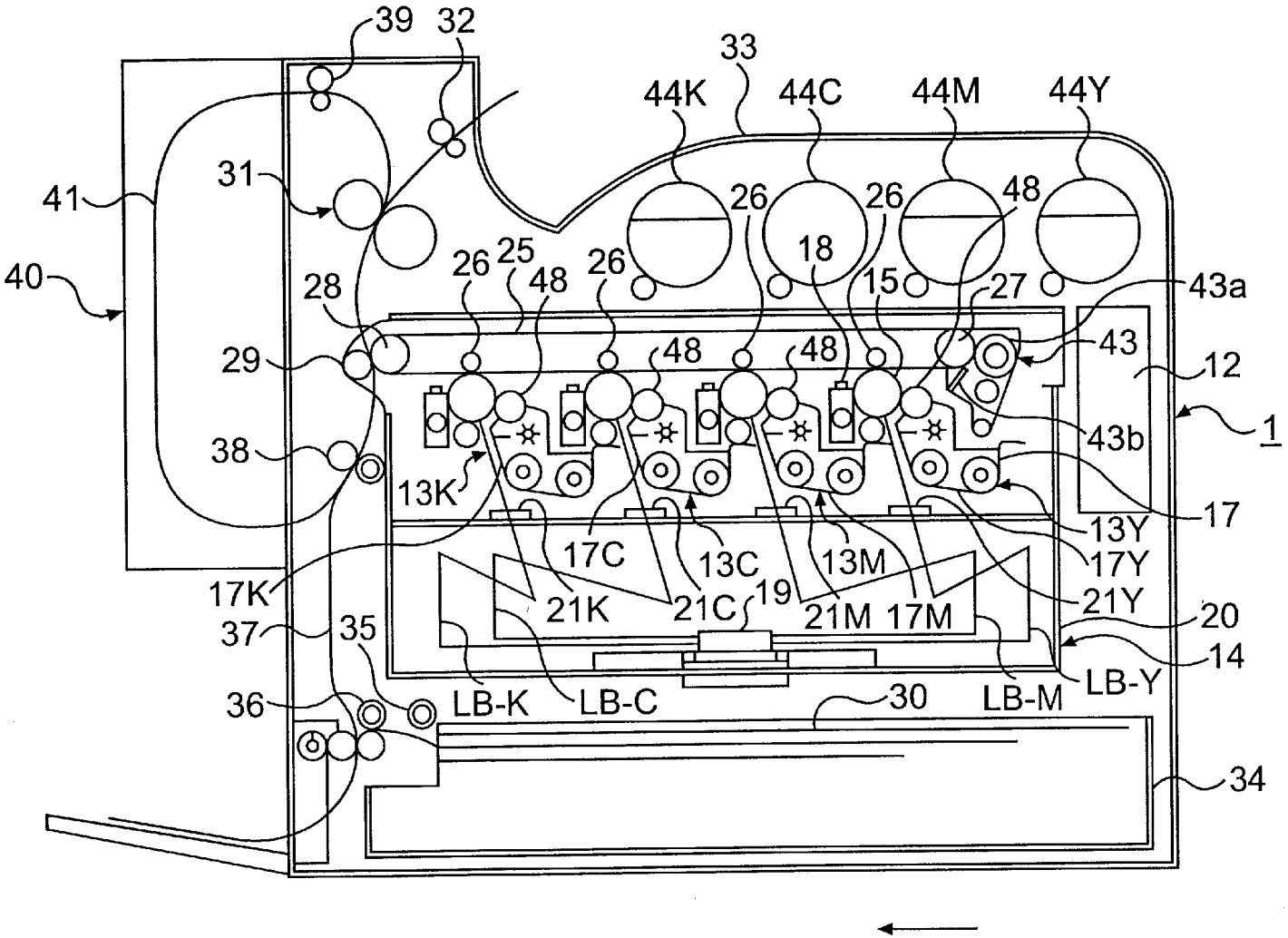
FIG. 2 is a constitutional view showing a color printer as an image forming apparatus according to the first embodiment.

FIG. 2 shows a tandem type digital color printer functioning as an image forming apparatus to which a toner supplying device according to a first embodiment of the invention is applied. Further, FIG. 3 shows a tandem type digital color copier functioning as an image forming apparatus to which the toner supplying device according to the first embodiment is applied.

Figure 3:
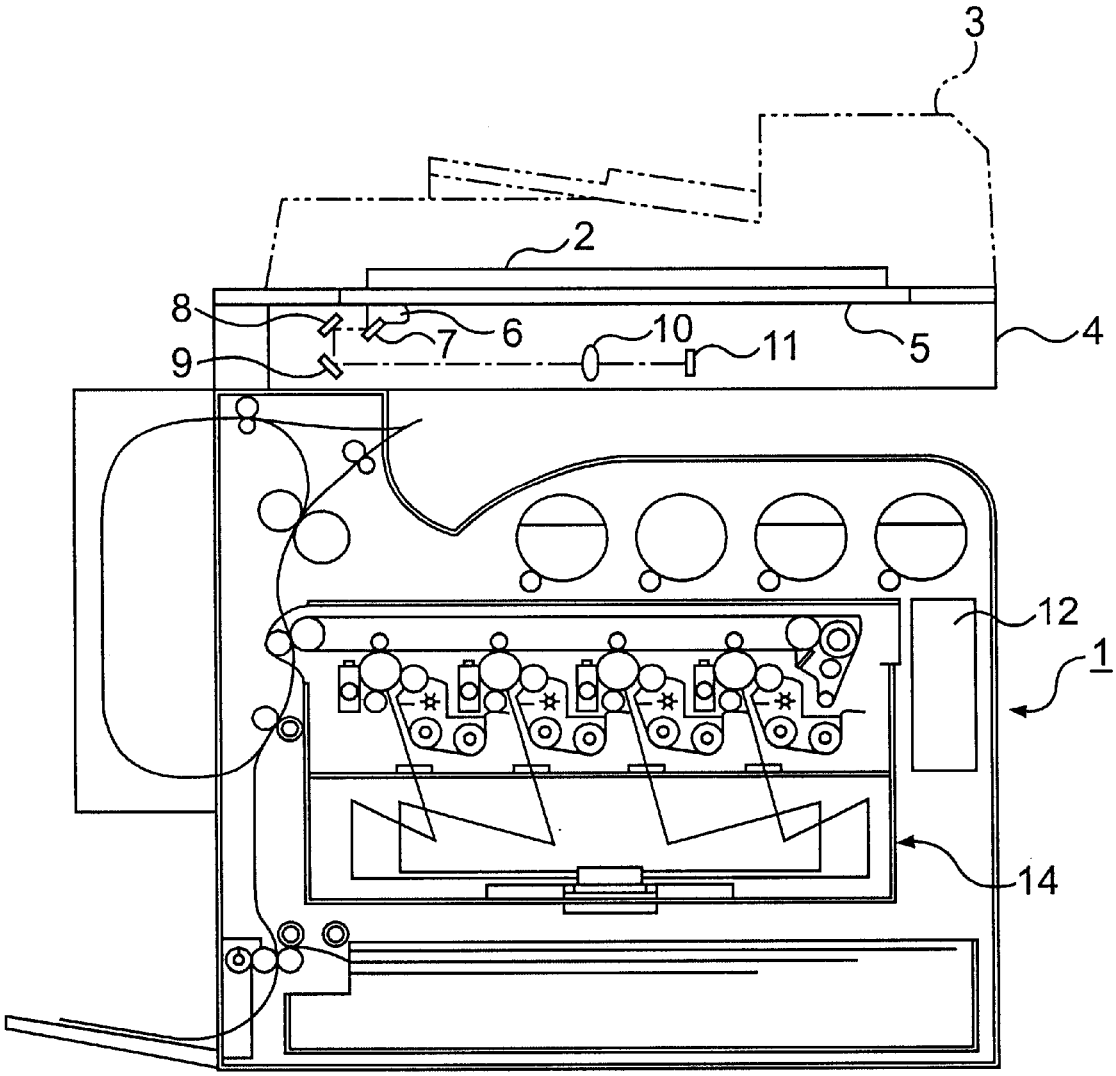
FIG. 3 is a constitutional view showing a color copier as an image forming apparatus according to the first embodiment.

In FIGS. 2 and 3, reference numeral 1 shows bodies of the tandem type digital color printer and copier. In case of the digital color copier, as shown in FIG. 3, at the upper portion of the body 1, there are provided an automatic document feeder (ADF) 3 for automatically feeding an original 2 one by one in a separation manner and an original reading device 4 for reading the original 2 transported by the automatic document feeder 3. In this original reading device 4, the original 2 placed on a platen glass 5 is illuminated by a light source 6; a reflected light image from the original 2 is scan-exposed on an image reading element 11 comprising CCD or the like through reduction optical system comprising a full rate mirror 7, half rate mirrors 8, 9, and an imaging lens 10; and a color material reflected light image of the original 2 is read by this image reading element 11 with a predetermined dot density (for example, 16 dots/mm).

The color material reflected light image of the original 2 read by the above original reading device 4 is fed to an IPS (Image Processing System) 12 as original reflection rate data of three colors, for example, red (R), green (G) and blue (B) (each is 8 bits). In this IPS 12, the reflection rate data of the original 2 is subjected to a predetermined image processing such as shading correction, deviation correction, lightness/color space conversion, gamma correction, frame deletion, color/movement editing, or the like. Further, the IPS 12 performs the predetermined image processing also in relation to image data fed from a personal computer or the like.

And, the image data subjected to the predetermined image processing by the IPS 12 as described above is converted by the IPS 12 into original reproduction color material tonal data of four colors comprising yellow (Y), magenta (M), cyan (C) and black (K) (Each is 8 bits.), and sent to a ROS (Raser Output Scanner) 14 of image forming units 13Y, 13M, 13C and 13K of each color of yellow (Y), magenta (M), cyan (C) and black (K). In this ROS 14 functioning as an image exposing device, image exposure is performed by laser beams LB according to the original reproduction color material tonal data of the predetermined color.

Inside the above tandem type digital color printer body and copier body 1, as shown in FIGS. 2 and 3, the four image forming units 13Y, 13M, 13C and 13K of yellow (Y), magenta (M), cyan (C) and black (K) are spaced in the horizontal direction and arranged in a row.

All these four image forming units 13Y, 13M, 13C and 13K are constituted similarly. To be divided broadly, each of them comprises a photoconductive drum 15 as an image carrier, which is driven and rotated at a predetermined speed; a charge roll 16 for primary charge, which charges uniformly a surface of this photoconductive drum 15; the ROS 14 as an image exposing device, which exposes the surface of the photoconductive drum 15 onto which the image corresponding to the predetermined color is carried to the light thereby to form an electrostatic latent image; a developing device 17 for developing the electrostatic latent image formed on the photoconductive drum 15 with toner of the predetermined color; and a cleaning device 18 for cleaning the surface of the photoconductive drum 15.

The above ROS 14, as shown in FIGS. 2 and 3, is constituted in common with the four image forming units 13Y, 13M, 13C and 13K, and so constituted that four semiconductive lasers (not shown) are modulated according to the original reproduction color material tonal data of each color, and that laser beams LB-Y, LB-M, LB-C and LB-K are issued from these semiconductive lasers according to the tonal data. Further, the above ROS 14 may be constituted individually in relation to each of the plural image forming units, needless to say. The laser beams LB-Y, LB-M, LB-C and LB-K issued from the above semiconductive lasers are irradiated through f-θ lenses (not shown) to a rotational polyhedral mirror 19, and they are deflection-scanned by this rotational polyhedral mirror 19. The laser beams LB-Y, LB-M, LB-C and LB-K deflection-scanned by the above rotational polyhedral mirror 19 are scanned and the photoconductive drums 15 are exposed to the laser beams through a plurality of reflection mirrors (not shown) from a diagonally lower side.

Since the above ROS 14, as shown in FIG. 2, scans the laser beams and exposes the photoconductive drum 15 to the laser beams form the lower side thereby to form the latent images, this ROS 14 has a fear that toner drops from the developing devices 17 of the four image forming units 13Y, 13M, 13C and 13K that are positioned upward thereby to stain the ROS 14. Therefore, the surroundings of the ROS 14 are tightly covered with a frame 20 formed in a shape of a rectangular parallelepiped, and windows 21Y, 21M, 21C and 21K made of a transparent glass, which function as a shield member, are provided above the frame 20 in order to expose the photoconductive drums 15 of the image forming units 13Y, 13M, 13C and 13K to the four laser beams LB-Y, LB-M, LB-C and LB-K. And, these windows 21Y, 21M, 21C and 21K made of the glass are positioned at the uppermost portion on optical paths along the laser beams LB of the ROS 14 functioning as the image exposing device.

From the above IPS 12, the image data of the respective colors are in order output to the ROS 14 provided in common with the image forming units 13Y, 13M, 13C and 13K of the colors of yellow (Y), magenta (M), cyan (C) and black (K). The laser beams LB-Y, LB-M, LB-C and LB-K issued from this ROS 14 according to the image data are scanned, and the surface of the corresponding photoconductive drum 15 is exposed to the laser beam thereby to form an electrostatic latent image. The electrostatic latent images formed on the above photoconductive drums 15 are respectively developed as a toner image of each color of yellow (Y), magenta (M), cyan (C) and black (K) by developing devices 17Y, 17M, 17C and 17K.

The toner images of the respective color of yellow (Y), magenta (M), cyan (C) and black (K), which have been formed in order on the photoconductive drums 15 of the above respective image forming units 13Y, 13M, 13C and 13K, are transferred in a multiplex manner by a primary transfer roll 26 onto a central transfer belt 25 laid above the respective image forming units 13Y, 13M, 13C and 13K. This central transfer belt 25 is laid between a drive roll 27 and a back-up roll 28 at a fixed tension, and it is circularly driven at a predetermined speed in a direction of an arrow by the drive roll 27 that is driven and rotated by a dedicated drive motor (not shown) that is superior in a constant speed property. As the above central transfer belt 25, for example, an endless belt is used, which is formed by forming a synthetic resin film such as PET having flexibility in a shape of a belt and then connecting both ends of the synthetic resin film formed in a shape of the belt by means such as welding or the like.

The toner images of the respective colors of yellow (Y), magenta (M), cyan (C) and black (K), which have been transferred onto the above central transfer belt 25 in the multiplex manner, are secondarily transferred onto a transfer sheet 30 with pressure-welding force and static electricity by a secondary transfer roll 29 pressure-welded to the back-up roll 28. The transfer sheet 30 onto which the toner image of each color has been transferred is transported to a fixing device 31 positioned upward. The above secondary transfer roll 29 is pressure-welded to a side of the back-up roll 28, and it secondarily transfers the toner image of each color onto the transfer sheet 30 that is transported from the lower side to the upper side. After the transfer sheet 30 onto which the toner image of each color has been transferred was subjected to fixing processing with heat and pressure by a fixing device 31, it is discharged by a discharge roll 32 onto a discharge tray 33 provided at the upper portion of the body 1.

The above transfer sheet 30 of a predetermined size, as shown in FIGS. 2 and 3, are transported once from a paper supplying cassette 34 by a paper supplying roller 35 and a paper separation roller pair for transportation 36 through a paper transporting path 37 to a register roll 38, and stopped. The transfer sheet 30 supplied from the above supplying cassette 34 is fed out to a secondary transfer position of the central transfer belt 35 by the register roll 38 that rotates at a predetermined timing.

In case that a duplex copy of full color is made in the above digital color printer or copier, without discharging intactly the transfer sheet 30 on one side of which an image has been fixed onto the discharge tray 33 by the discharge roll 32, a transporting direction is switched by a switching gate (not shown), and then the transfer sheet 30 is transported through a paper feeding roller pair 39 to a duplex copy transporting unit 40. And, in this duplex copy transporting unit 40, by a feeding roller pair (not shown) provided along a transporting path 41, the transfer sheet 30 is transported again to the register roll 38 in a state where both sides of the transfer sheet 30 are reversed. An image is transferred and fixed onto a rear surface of the transfer sheet 30 this time, and thereafter the transfer sheet 30 is discharged onto the discharge tray 33.

In FIGS. 2 and 3, reference numerals 44Y, 44M, 44C and 44K represent respectively a toner cartridge for supplying toner of the predetermined color to the developing device 17 of each color of yellow (Y), magenta (M), cyan (C) and black (K).

Figure 4:
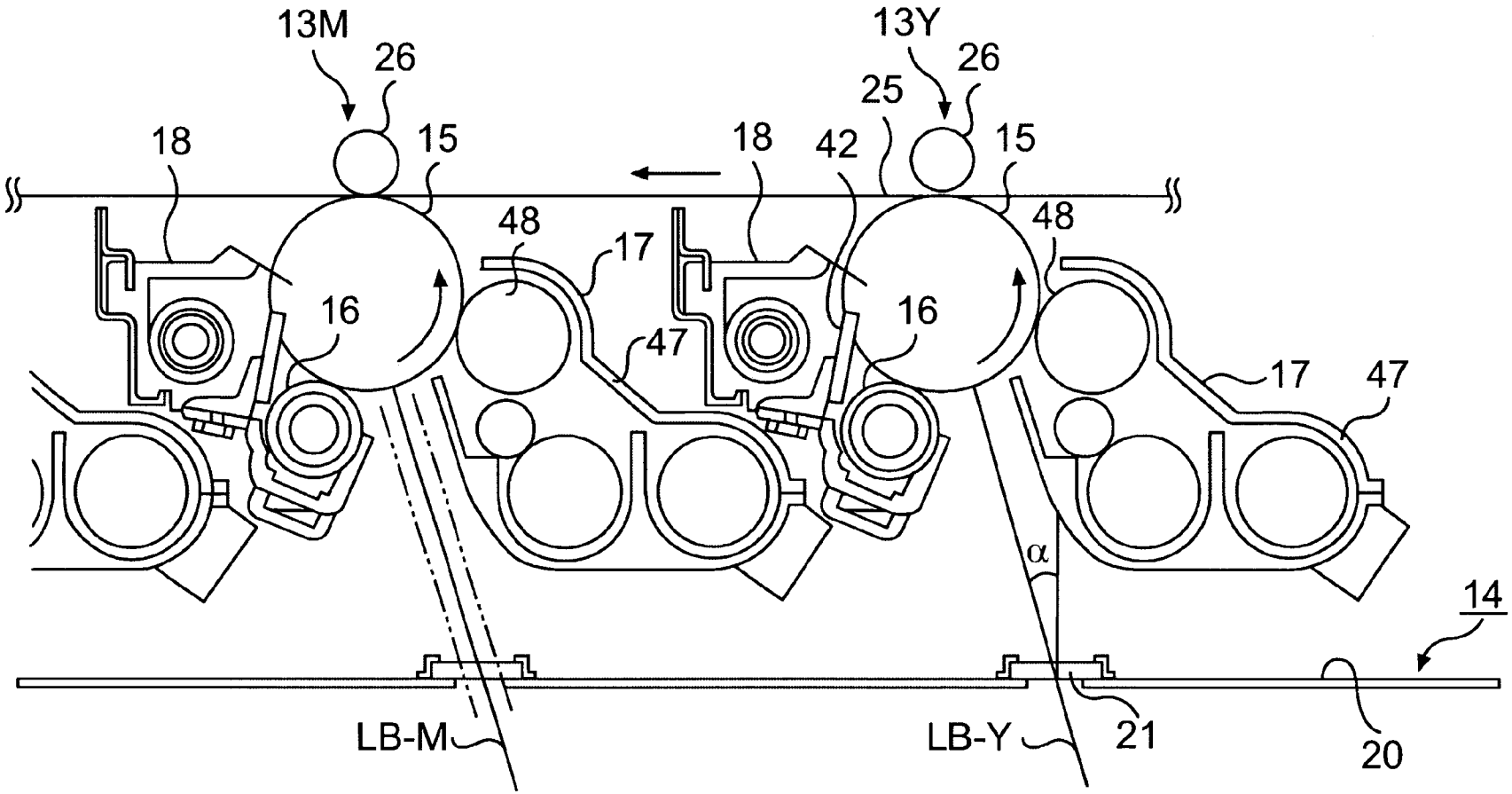
FIG. 4 is a constitutional view showing an image forming portion.

FIG. 4 shows each image forming unit of the above digital color printer or copier.

All the four image forming units 13Y, 13M, 13C and 13K of yellow color, magenta color, cyan color and black color are similarly constituted as shown in FIG. 4. In these four image forming units 13Y, 13M, 13C and 13K, as described above, the toner images of yellow color, magenta color, cyan color and black color are respectively formed in order at the predetermined timing. The above image forming units 13Y, 13M, 13C and 13K of the respective colors, as described above, have their photoconductive drums 15. The surfaces of these photoconductive drums 15 are charged uniformly by the charging roll 16 for primary charging. Thereafter, the image forming laser beams LB-K, LB-C, LB-M and LB-Y issued from the ROS 14 according to the image data are scanned on the surfaces of the above photoconductive drums 15 and their surfaces are exposed to the beams, so that an electrostatic latent image corresponding to each color is formed. The laser beam LB scanned on the above photoconductive drum 15 to the beam rather from the direction off to the lower right of the photoconductive drum 15 than from a direction just under the photoconductive drum 15, at a predetermined tilt angle $\alpha$. The electrostatic latent images formed on the above photoconductive drums 15 are respectively developed by the developing rolls 48 of the developing devices 17 of the image forming units 13Y, 13M, 13C and 13K with the toner of each color of yellow color, magenta color, cyan color and black color, so that their images become visible toner images. These visible toner images are transferred in order onto the central transfer belt 25 in a multiple manner by charging of the primary transfer rolls 26.

The surface of the photoconductive drum 15 after the transfer process of the toner image has been completed is cleaned by a cleaning device 18 to remove the residual toner, paper dusts and the like, and it is prepared for a next image forming process. The above cleaning device 18 has a cleaning blade 42, by which the residual toner, the paper dusts, and the like on the photoconductive drum 15 are removed. Further, the surface of the central transfer belt 25 after the transfer process of the toner image has been completed is, as shown in FIGS. 2 and 3, cleaned by a cleaning device 43 to remove the residual toner, paper dusts and the like, and it is prepared for a next image forming process. The above cleaning device 43 has a cleaning brush 43*a* and a cleaning blade 43*b*, by which the residual toner, the paper dusts, and the like on the central transfer belt 25 are removed.

Figure 5:
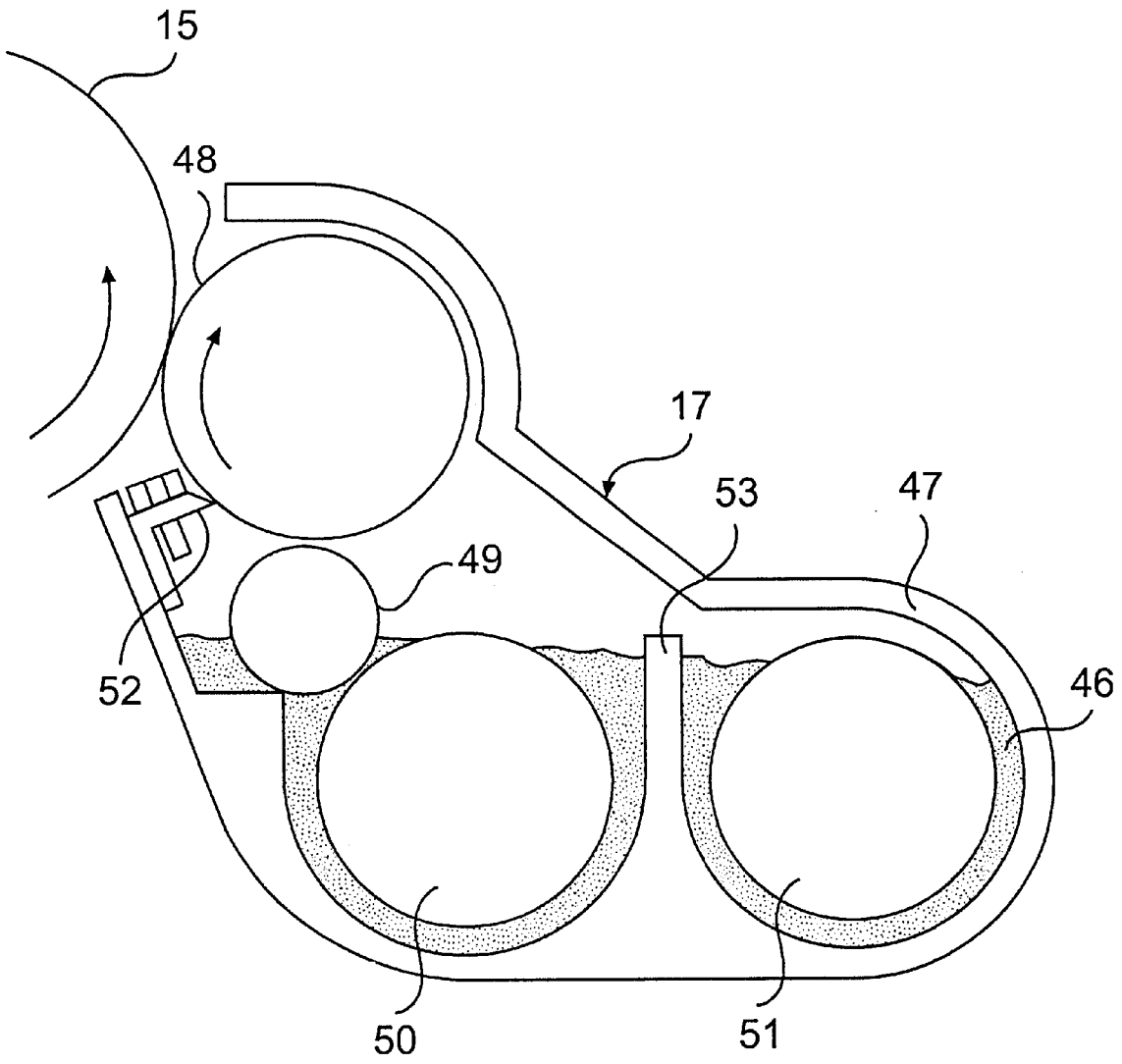
FIG. 5 is a constitutional view showing a developing device.
Figure 6:
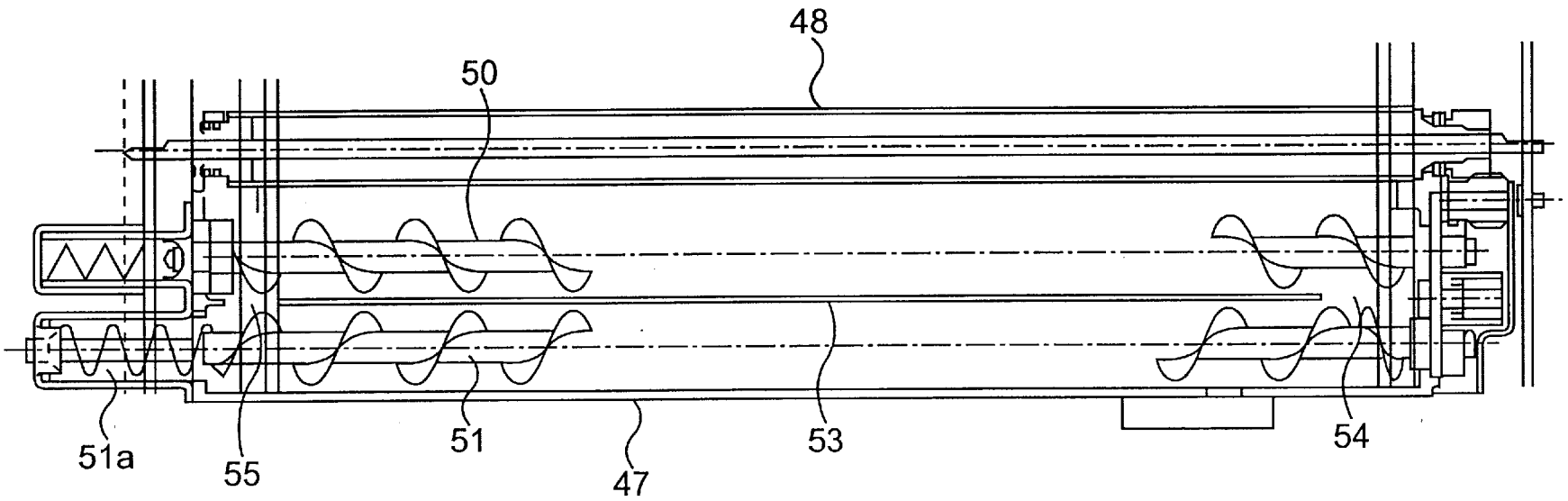
FIG. 6 is a constitutional view showing the developing device.
Figure 7:
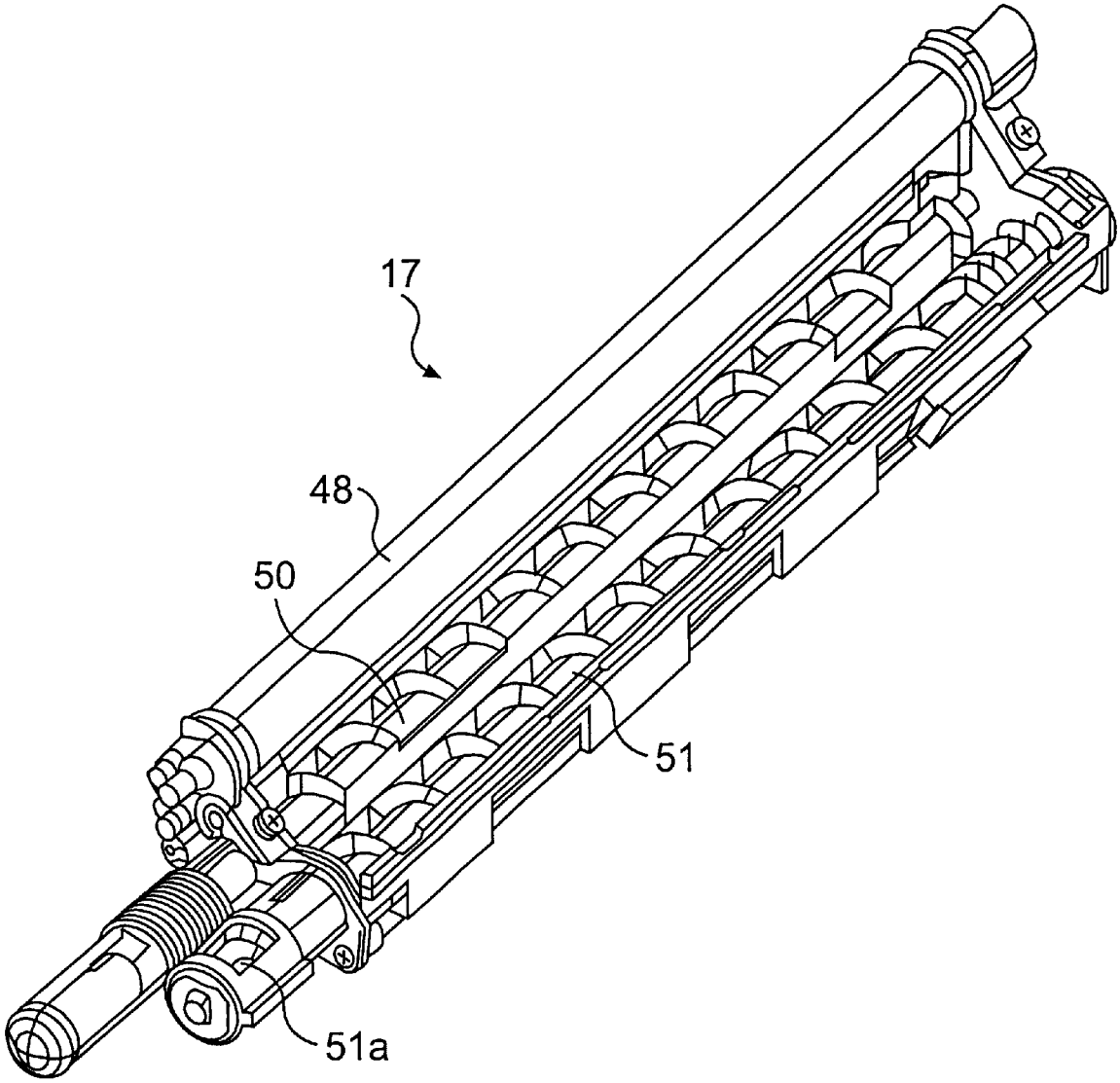
FIG. 7 is a perspective constitutional view showing the developing device.

FIGS. 5 to 7 show respectively the developing device 17 used in each of the image forming units 13Y, 13M, 13C and 13K.

This developing device 17, as shown in FIGS. 5 to 7, has a biconstituent developer 46 comprising toner and carrier of the color of the corresponding image forming units 13Y, 13M, 13C and 13K. And, the developing device 17 is composed of a developing roll 48 disposed on the photoconductive drum 15 side of a developing device housing 47; a developer transporting paddle 49 disposed below this developing roll 48; developer transporting and stirring augers 50, 51 disposed on a back surface of this developer transporting paddle 49; and a blade 52 for regulating the layer thickness of the developer 46 transported by the developing roll 48. In this case, the above developing roll 48 comprises a developing sleeve (not shown) composed of non-magnetic conductive member; for example, aluminum alloy, stainless steel or the like; and a magnet roll (not shown) fixed inside the developing sleeve. Further, between the above two developer transporting and stirring augers 50 and 51, a partition plate 53 is provided.

Further, the above developing device 17 is so constituted that the toner is supplied inside the device 17 at the predetermined timing by a toner supplying device according to the embodiment, which will be described later. Regarding the toner supplied from the above toner supplying device, as shown in FIGS. 6 and 7, the toner of the predetermined color is supplied to one end portion 51*a* of the developer transporting and stirring auger 51. While the toner supplied inside this developing device 17 is being transported by the developer transporting and stirring auger 51 in the longitudinal direction of the developing device 17, it is stirred and mixed with the developer 46, and then passed to the other developer transporting and stirring auger 50 through a passage 54 provided at one end portion of the partition plate 53. The developer 46 passed to this developer transporting and stirring auger 50, while it is being transported in an axial direction of the developer transporting and stirring auger 50, is stirred and mixed with the developer 46, and then again supplied to the other developer transporting and stirring auger 51 through a passage 55 provided at the other end portion of the partition plate 53. The toner thus supplied inside the above developing device 17 is transported together with the developer 46 within the developing device 17 by the two developer transporting and stirring augers 50, 51 thereby to be stirred and mixed with the developer; it is friction-charged with the charging amount of the predetermined polarity by the carrier; its part is transported by the developer transporting paddle 49 to the developing roll 48; and it is used in developing the electrostatic latent image on the photoconductive drum 15.

In this embodiment, in the toner supplying device in which the developing device to which the toner is to be supplied is arranged on a lower side and the toner supplying device is arranged on an upper side, and the toner is supplied through a first transporting passage disposed in a substantially horizontal direction and a second transporting passage disposed in a substantially vertical direction; the toner supplying device is so constituted that a transporting member for transporting the toner by its rotation is provided inside the first transporting passage, and that a transporting member provided inside the second transporting passage is moved in the vertical direction through a converter for converting the rotation of the transporting member provided inside the first transporting passage into reciprocation.

Further, in this embodiment, the converter for converting the rotation of the transporting member provided inside the first transporting passage into the reciprocation is composed of a crank-shaped shaft provided for the transporting member disposed inside the first transporting passage.

Figure 1:
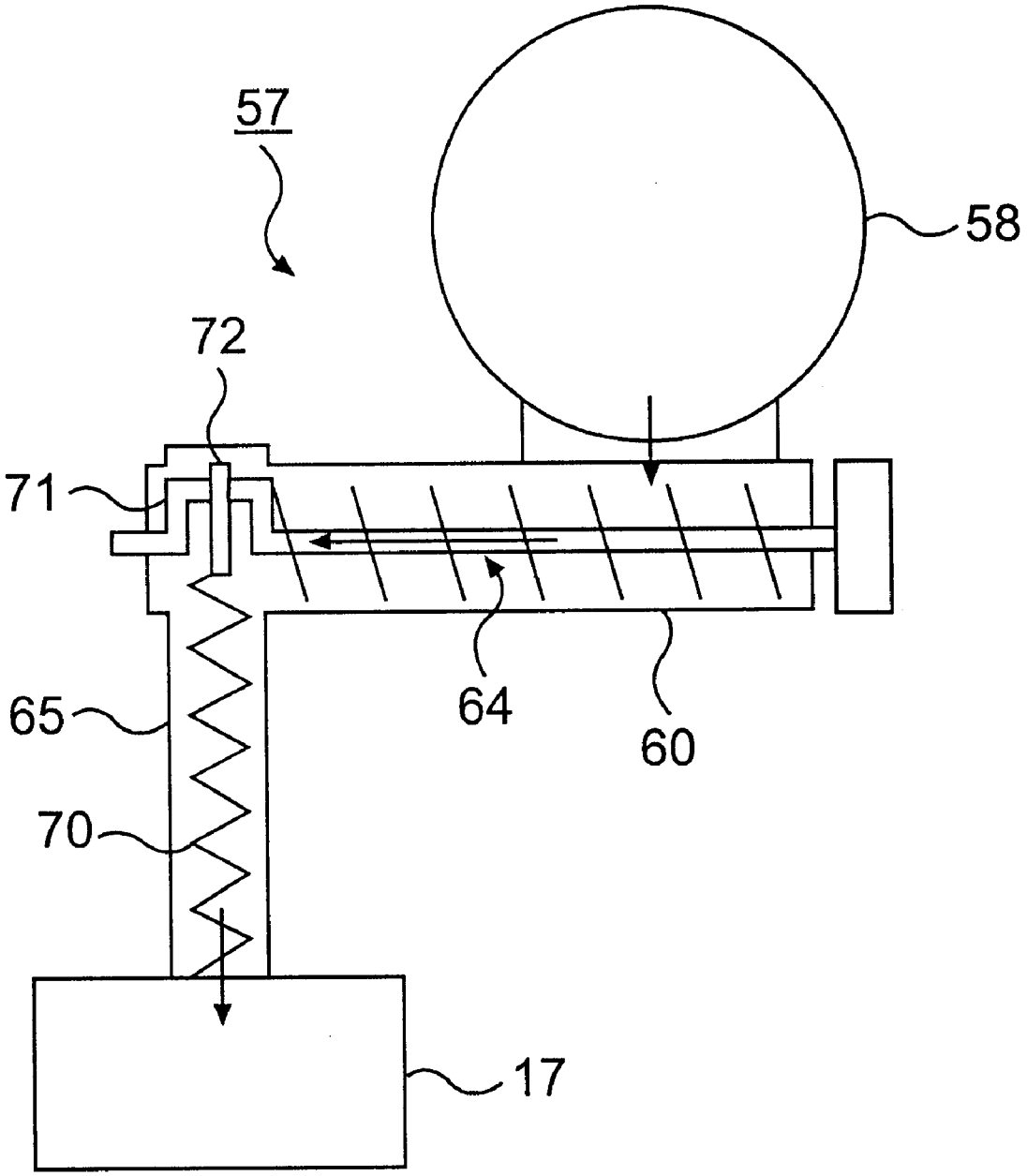
FIG. 1 is a schematic constitutional view showing a toner supplying device according to a first embodiment of the invention.
Figure 8:
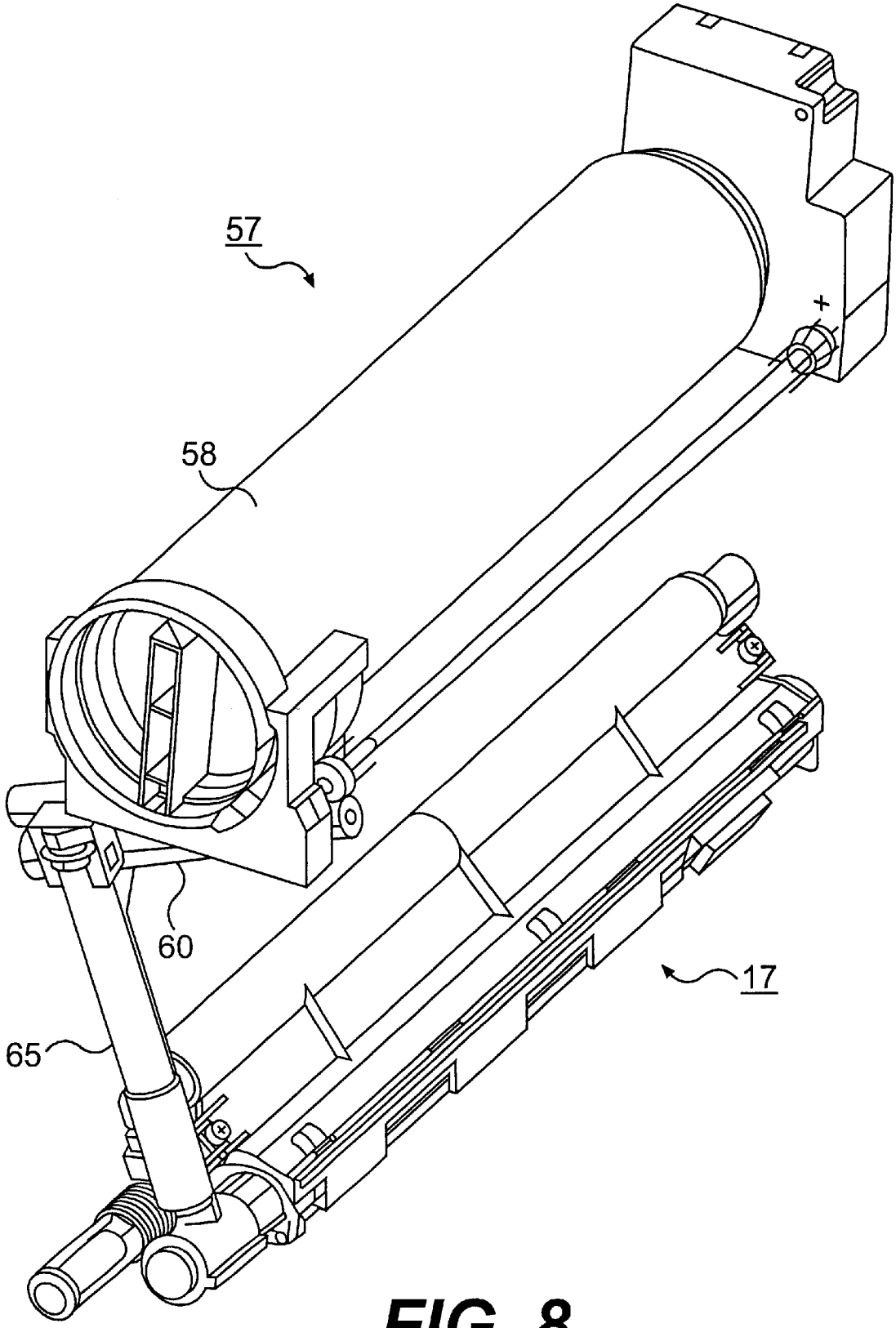
FIG. 8 is a perspective constitutional view showing the toner supplying device according to the first embodiment.
Figure 9:
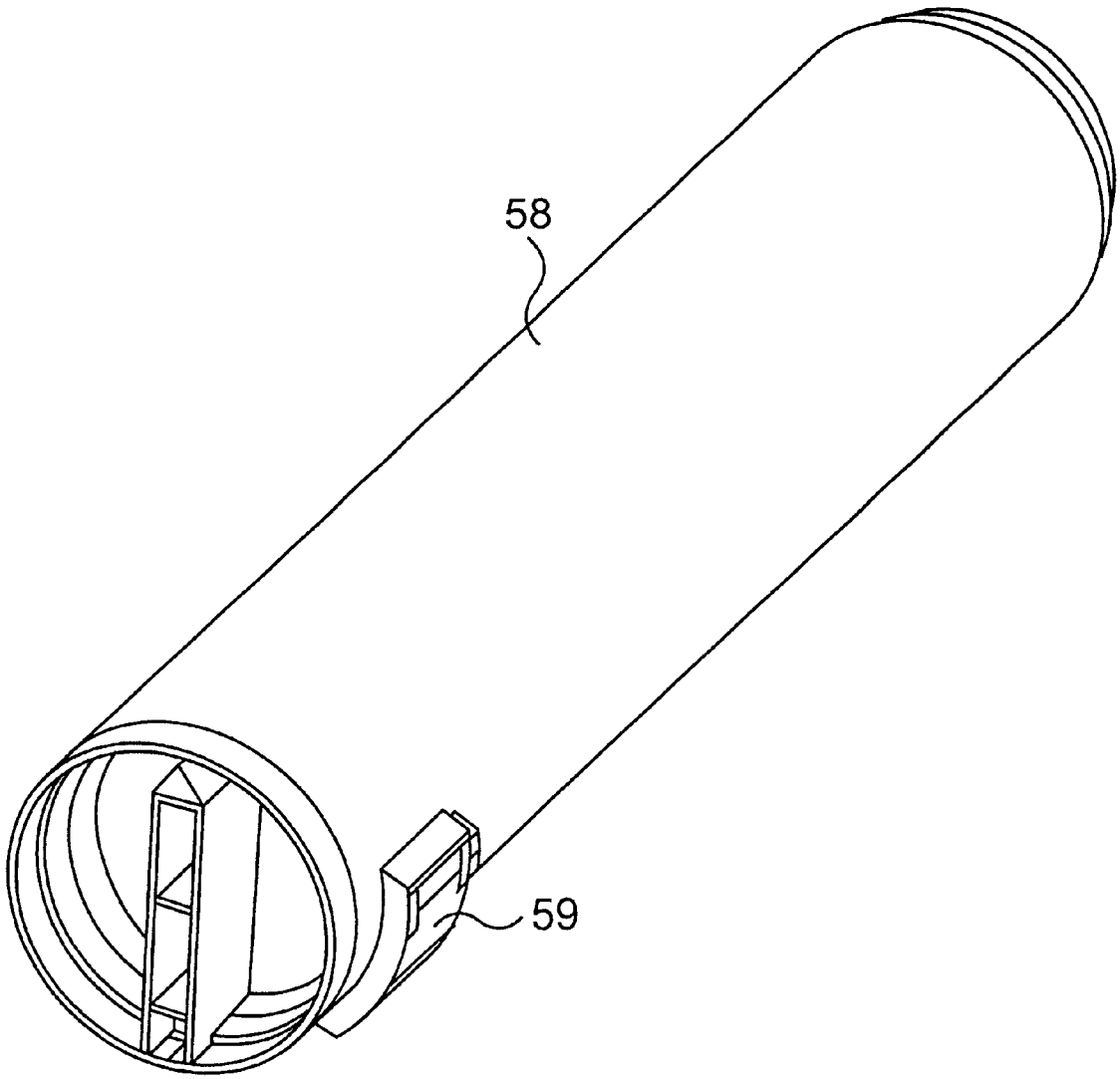
FIG. 9 is a perspective constitutional view showing a toner cartridge.
Figure 10:
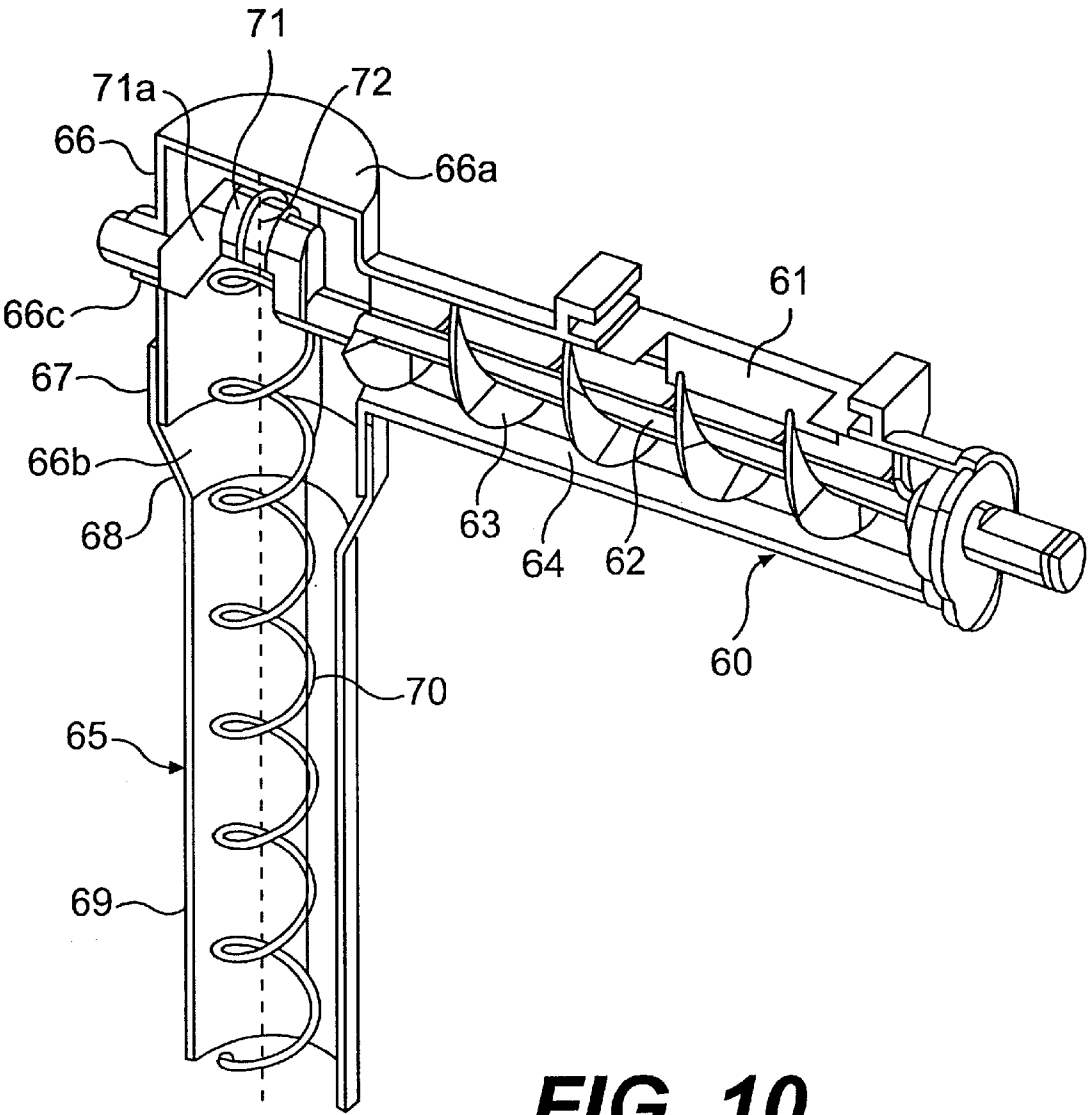
FIG. 10 is a longitudinal sectional view showing a main portion of the toner supplying device according to the first embodiment.

The digital color printer or copier onto which the above toner supplying device is mounted is so constituted, as shown in FIGS. 1 and 8, that the developing device 17 is position on the lower side and the toner supplying device 57 is positioned on the upper side, and that the developing device 17 and the toner supplying device 57 are spaced from each other some degree. The above toner supplying device 57 is provided with a toner cartridge 58 in which the toner image of the predetermined color is stored. This toner cartridge 58, as shown in FIG. 9, has a toner supplying port 59 that opens or closes by rotating in the predetermined direction in a state where the toner cartridge 58 is mounted onto the predetermined position of the printer body 1. The toner supplied from the toner supplying port 59 of the above toner cartridge 58, as shown in FIGS. 1, 8 and 10, is supplied into an induction port 61 of a first toner transporting passage 60 disposed in the substantially horizontal direction. This first toner transporting passage 60 is formed substantially in a shape of a cylinder, and an auger 64 in which spiral transporting vanes 63 are formed integrally at the periphery of a rotational shaft 62 is rotatably disposed inside the transporting passage 60. The above auger 64 is driven and rotated by a drive motor (not shown) disposed at one end portion of the rotational shaft 62 of the auger 64 at the predetermined timing and by the predetermined amount.

To a leading end portion of the above first toner transporting passage 60, a second toner transporting passage 65 disposed in the substantially vertical direction is coupled. At the leading end portion of the above first toner transporting passage 60, a cylindrical portion 66 that is disposed short in the substantially vertical direction is integrally formed; an upper end 66*a* of the cylindrical portion 66 is closed; and a lower end 66*b* thereof is opened. And, to the cylindrical portion 66 of the above first toner transporting passage 60, the second toner transporting passage 65 is coupled in a state where an upper end portion 67 of the second toner transporting passage 65, of which the diameter is made larger is fitted to the lower end portion of the cylindrical portion 66. The above second toner transporting passage 65 is so formed that a cylindrical portion 69 of which the diameter is smaller than that of the upper end portion 67 extends long from the upper end portion 67 of which the diameter is made larger through a short taper portion 68. Further, inside the above second toner transporting passage 65, a spring agitator 70 that is made of metal wire and formed spirally is rotatably disposed.

Further, in the auger 64 disposed inside the first toner transporting passage 60, the spiral transporting vanes 63 formed at the periphery of its rotational shaft 62 are formed up to an inlet of the cylindrical portion 66, and the leading end portion of the rotational shaft 62 is supported through a crank portion 71 disposed inside the cylindrical portion 66 by a side wall 66*c* of the cylindrical portion 66. Further, to the crank portion 71 of the above auger 64, the spring agitator 70 is coupled in a state where a hook portion 72 of the spring agitator 70, which is curved substantially in a shape of a circle, is inserted into the crank portion 71. Further, a portion 71*a* on a leading end side of the crank portion 71 of the above auger 64 is disposed slantingly so that the hook portion 72 provided at the end portion of the spring agitator 70 inside the cylindrical portion 66 and curved substantially in a shape of the circle can be inserted readily. Further, an inner diameter of the hook portion 72 of the spring agitator 70 is set a little larger than an axial diameter of the crank portion 71. When the auger 64 rotates, the spring agitator 70 moves in the vertical direction in the second transporting passage 65.

In the toner supplying device according to this embodiment, an increase in cost caused by increase of the number of parts is prevented and it is prevented that the apparatus becomes larger by the following constitution. The developing device is positioned on the lower side and the toner supplying device is positioned on the upper side, and the developing device and the toner supplying device are spaced from each other in some degree. Further, in this toner supplying device, freedom of layout of the transporting passage through which the toner is transported from the toner supplying device to the developing device is large, and there is no fear that stress will be given to the toner transported along the transported passage and a bad influence will be exerted on the toner.

Namely, in the toner supplying device according to this embodiment, as shown in FIGS. 1 and 8, the toner is supplied from the toner supplying device 57 position on the upper side to the developing device 17 positioned on the lower side. The toner supplied from the toner cartridge 58 of the above toner supplying device 57, as shown in FIGS. 8 and 10, is supplied into the induction port 61 of the first toner transporting passage 60. The toner supplied into this first toner transporting passage 60 is transported in the longitudinal direction of the first toner transporting passage 60 by rotating and driving by the predetermined mount the auger 64 that is rotatably disposed inside the first toner transporting passage 60. This toner transported in the longitudinal direction of the first toner transporting passage 60 is supplied in a dropped state into the second toner transporting passage 65 disposed so as to extend from the leading end portion of the first toner transporting passage 60 in the substantially vertical direction. The toner supplied into the above second toner transporting passage 65 drops downward by its own weight, and supplied to the end portion of the developing device 17.

At this time, inside the above second toner transporting passage 65, the spring agitator 70 is disposed, and the upper end portion of the spring agitator 70 is coupled to the crank portion 71 of the auger 64 that is rotatably provided inside the first toner transporting passage 60. Therefore, when the auger 64 inside the above first toner transporting passage 60 is driven and rotated, the spring agitator 70 coupled to the crank portion 71 of the auger 64 moves in the vertical direction at the predetermined stroke. Accordingly, the toner that drops naturally into the second toner transporting passage 65 is prevented from sticking to the wall surface of the second toner transporting passage 65 by the spring agitator 70 that moves in the vertical direction at the predetermined stroke, so that the toner is reliably supplied to the developing device 17.

As described above, in the toner supplying device 57 according to the above embodiment, since the crank portion 71 is only provided at the leading end portion of the auger 64 provided inside the first toner transporting passage 60 and the leading end portion of the spring agitator 70 provided inside the second toner transporting passage 65 is only coupled to the crank portion 71 of the auger 64 rotatably, the constitution is simple, and the increase of the parts is not caused, so that the increase in cost caused by the increase of the number of parts is prevented and the apparatus is prevented from becoming larger. Further, since the first toner transporting passage 60 disposed in the substantially horizontal direction and the second toner transporting passage 65 disposed in the substantially vertical direction are only coupled to each other, the freedom of the layout becomes large by changing freely the lengths and the setting angles of the first and second toner transporting passages 60 and 65.

Further, since the spring agitator 70 disposed inside the second toner transporting passage 65 only moves in the vertical direction and it is not pressure-welded to the inner wall of the second transporting passage 65, the stress is not given to the toner transported along the second toner transporting passage 65, so that there is no fear that the bad influence will be exerted on the toner.

Figure 11:
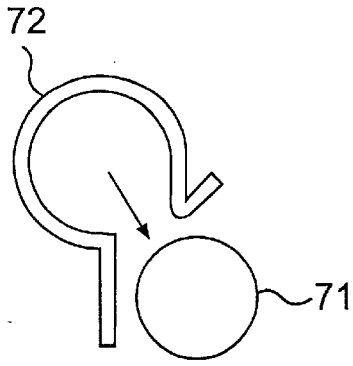
FIG. 11 is a constitutional view showing a modified example of a spiral agitator.

In the aforesaid embodiment, the portion 71*a* on the leading end side of the crank portion 71 of the auger 64 is provided slantingly so that the crank portion 71 of the auger 64 can be readily inserted to the hook portion 72 that is provided at the leading end portion of the spring agitator 70 and formed substantially in a shape of the circle. However, in case that the hook portion 72 that is provided at the leading end portion of the spring agitator 70 and formed substantially in the shape of the circle is elastically transformed and forced to the crank portion 71 of the auger 64 so as to snap-fit to the crank portion 71 as shown in FIG. 11, it is no necessary to provide the slanting portion 71*a* at the portion on the leading end side of the crank portion 71 of the auger 64.

Figure 12:
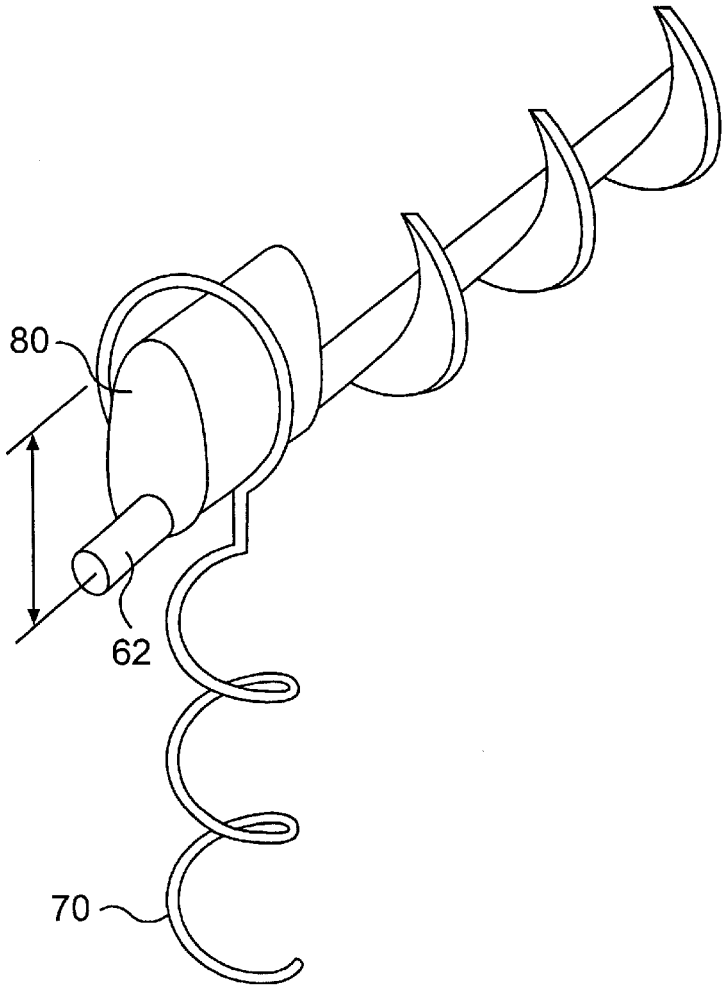
FIG. 12 is a constitutional view showing a modified example of a converter.
Figure 13A:
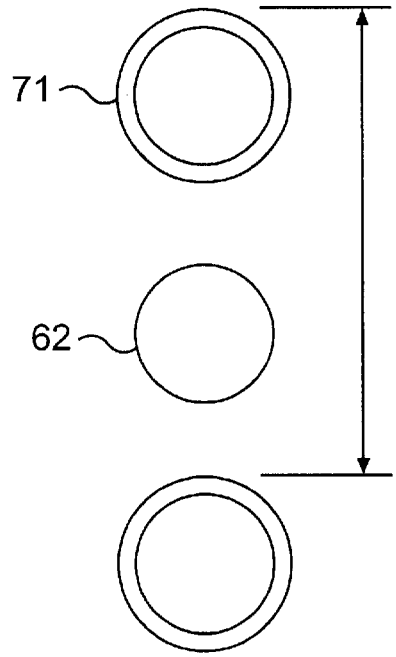
FIGS. 13A and 13B are constitutional views each showing a modified example of the converter.
Figure 13B:
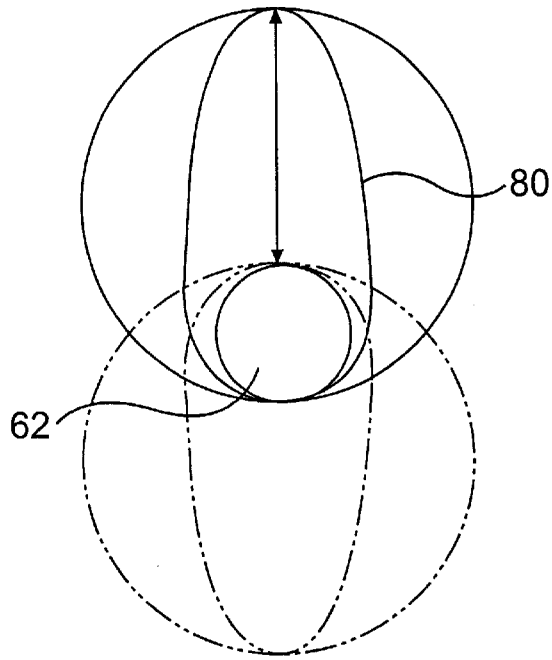
Figure 14:
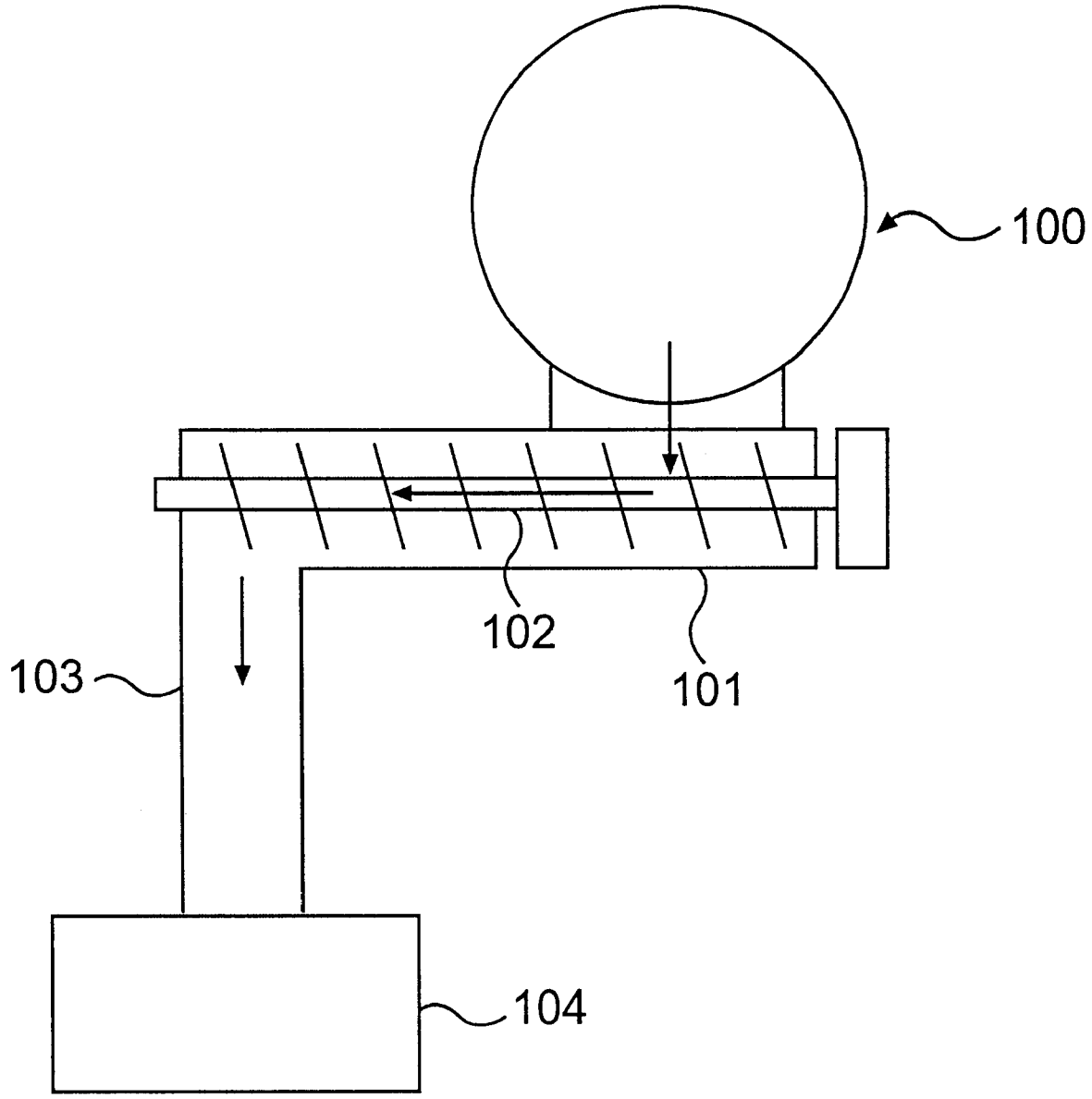
FIG. 14 PRIOR ART
FIG. 14 is a constitutional view showing a conventional toner supplying device.
Figure 15:
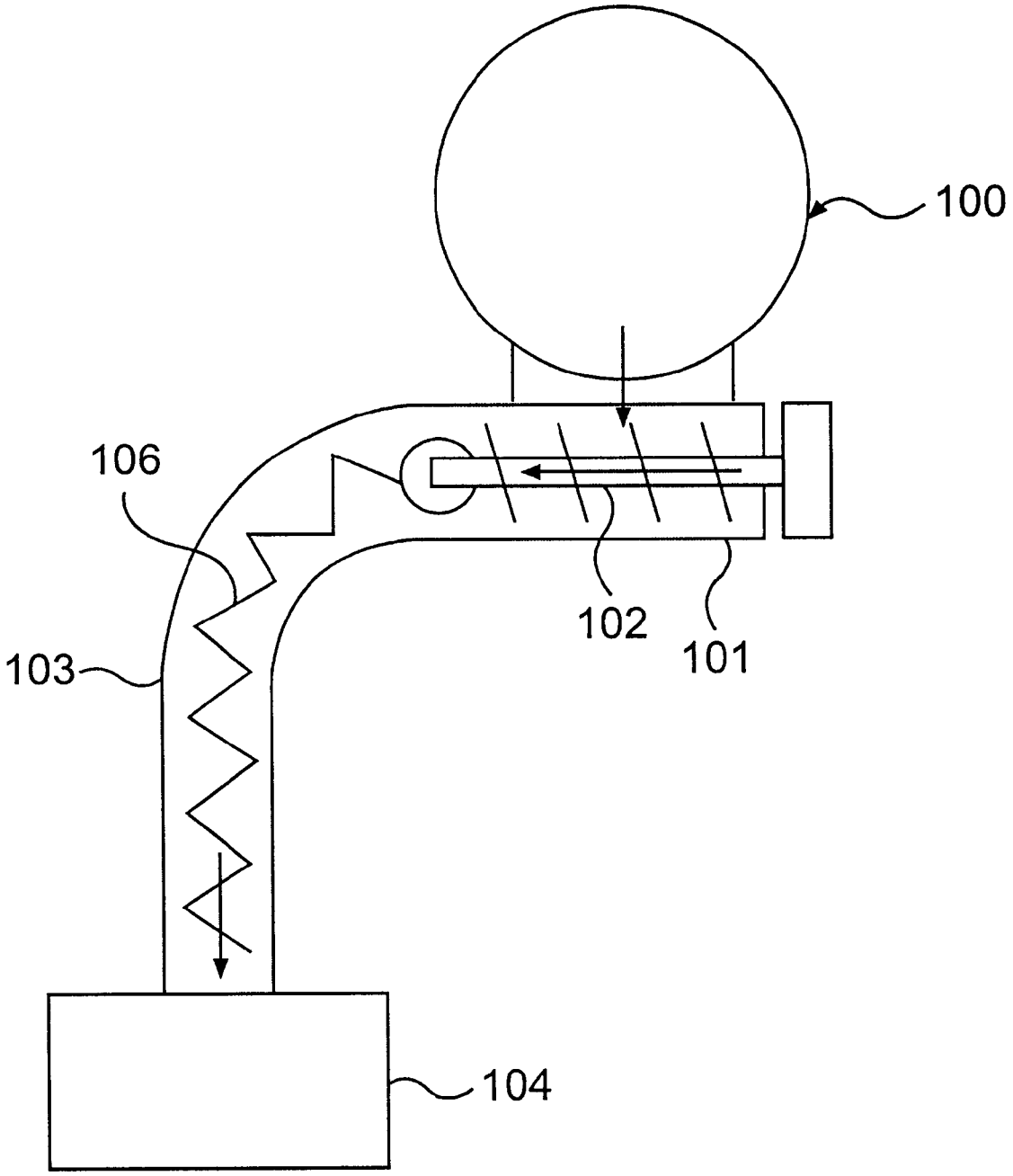
FIG. 15 is a constitutional view showing a conventional toner supplying device.
Figure 16:
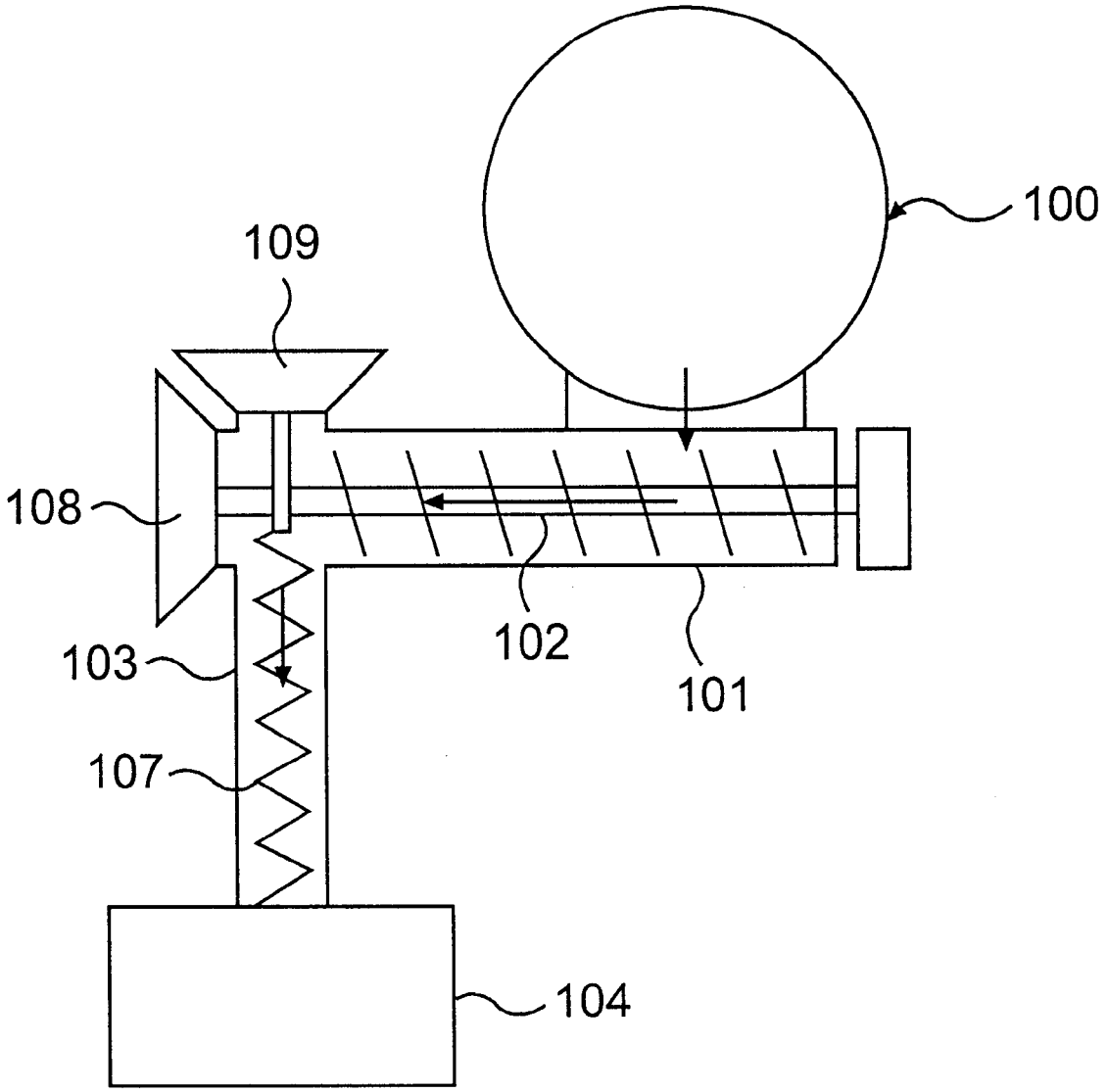
FIG. 16 PRIOR ART
FIG. 16 is a constitutional view showing a conventional toner supplying device.

Further, in the aforesaid embodiment, the crank portion 71 is provided at the leading end portion of the auger 64 disposed inside the first toner transporting passage 60. As a substitute for this crank portion 71, as shown in FIG. 12, an eccentric cam portion 80 may be provided at the leading end portion of the auger 64. However, in case that the eccentric cam portion 80 is provided at the leading end portion of the auger 64 as shown in FIG. 13, the stroke of the vertical movement of the spring agitator 70 becomes a little smaller than in a case that the crank portion 71 is provided.

As described above, according to the invention, a toner supplying device can be provided, which has such a constitution that a developing device is positioned on a lower side, the toner supplying device is positioned on an upper side, and their devices are spaced from each other in some degree, which makes large the freedom of the layout of a transporting passage along which toner is transported from the toner supplying device to the developing device, without causing an increase in cost caused by the increase of the number of parts and making the apparatus larger, and which has no fear that stress will be given to the toner transported along the transporting passage and a bad influence will be exerted on the toner.

What is claimed is:

1. A toner supplying device comprising:

a toner supplying unit, the toner suplying unit disposed below a toner receiving unit in height;

a first transporting passage disposed in a substantially horizontal direction;

a second transporting passage disposed in a substantially vertical direction, the second transporting passage connected to the first transporting passage;

a first transporting member disposed inside the first transporting passage, the first transporing member rotating to transport the toner from the toner supplying unit to the second transporting passage;

a second transporting member disposed inside the second transporting passage, the second transporting member reciprocating in the vertical direction to transport the toner from the first transporting passage to the toner receiving unit; and a converter for converting the rotation of the first transporting member into the reciprocation of the second transporting member.

2. The toner supplying device according to claim 1, wherein the converter includes a crank-shaped shaft provided in the first transporting member disposed inside the first transporting passage.

3. The toner supplying device according to claim 1, wherein the converter includes an eccentric cam provided in the first transporting member disposed inside the first transporting passage.

4. The toner supplying device according to claim 1, wherein the toner receiving unit is an image forming apparatus.

5. A developer transporting device for transporting developer from an upper portion to a lower portion, the developer transporting device comprising:

a first transporting passage disposed in a substantially horizontal direction;

a second transporting passage disposed in a substantially vertical direction, the second transporting passage connected to the first transporting passage;

a first transporting member provided inside the first transporting passage and rotating to transport the developer to the second transporting passage;

a second transporting member provided inside the second transporting passage and reciprocating to transport the developer; and a converter for converting the rotation of the first transporting member into the reciprocation of the second transporting member.

6. A developer transporting device for transporting developer from an upper portion to a lower portion, the developer transporting device comprising:

a first transporting passage disposed in a substantially horizontal direction;

a second transporting passage disposed in a substantially vertical direction, the second transporting passage connected to the first transporting passage;

a first transporting member provided inside the first transporting passage and rotating to transport the developer to the second transporting passage;

a second transporting member provided inside the second transporting passage and reciprocating to transport the developer; and a converter for converting the reciprocation of the second transporting member into the rotation of the first transporting member.

* * * * *